US007201559B2

(12) United States Patent
Gendraud et al.

(10) Patent No.: US 7,201,559 B2
(45) Date of Patent: Apr. 10, 2007

(54) STATIONARY RING ASSEMBLY FOR A GAS TURBINE

(75) Inventors: Alain Gendraud, Vernou la Celle/Seine (FR); Delphine Roussin-Moynier, Antony (FR)

(73) Assignee: Snecma, Paris (FR)

( * ) Notice: Subject to any disclaimer, the term of this patent is extended or adjusted under 35 U.S.C. 154(b) by 0 days.

(21) Appl. No.: 11/110,885

(22) Filed: Apr. 21, 2005

(65) Prior Publication Data

US 2005/0248100 A1 Nov. 10, 2005

(30) Foreign Application Priority Data

May 4, 2004 (FR) ..... 04 04737

(51) Int. Cl.
*F01D 11/14* (2006.01)

(52) U.S. Cl. ..... 415/173.1; 415/139; 277/641

(58) Field of Classification Search ..... 415/139, 415/173.1, 173.4; 277/641, 642, 644, 654
See application file for complete search history.

(56) References Cited

U.S. PATENT DOCUMENTS 4,524,980 A * 6/1985 Lillibridge et al. ..... 277/641
5,154,577 A 10/1992 Kellock et al.
5,709,530 A * 1/1998 Cahill et al. ..... 415/170.1
2004/0141838 A1* 7/2004 Thompson ..... 415/209.3
2005/0232752 A1* 10/2005 Meisels ..... 415/116

FOREIGN PATENT DOCUMENTS

EP 0 147 354 7/1985
EP 0 545 589 6/1993

OTHER PUBLICATIONS

French Search Report No. FR 0404737 FA 650562, dated Jan. 3, 2005, 2 pages.

* cited by examiner

*Primary Examiner*—Edward K. Look
*Assistant Examiner*—Nathan Wiehe
(74) *Attorney, Agent, or Firm*—Oblon, Spivak, McClelland, Maier & Neustadt, P.C.

(57) ABSTRACT

A stationary ring assembly forming a rotor shroud for a gas turbine including a plurality of segments having adjacent side faces that are placed end to end with sealing means interposed therebetween. The sealing means include at least one axial sealing strip and at least one radial sealing strip respectively received in axial slots and in radial slots formed facing one another in the adjacent side faces of the segments. At least one end of each radial slot opens out into the corresponding axial slot, each axial slot of a segment presents a depth that is greater than the depth of the corresponding radial slot, and the axial sealing strip presents a width that is greater than the width of the radial strip.

8 Claims, 2 Drawing Sheets

STATIONARY RING ASSEMBLY FOR A GAS TURBINE

BACKGROUND OF THE INVENTION

The present invention relates to the general field of stationary ring assemblies for gas turbines. It relates more particularly to stationary ring assemblies for turbomachine high-pressure turbines when the assemblies are of the type constituted by a plurality of segments joined end to end with sealing strips interposed therebetween.

In a gas turbine, e.g. a turbomachine high-pressure turbine, the rotor-forming moving blades are surrounded by a stationary ring assembly forming a shroud. The stationary ring assembly thus defines one of the walls of the flow path for the hot gas coming from the combustion chamber of the turbomachine and passing through the turbine.

The stationary ring assembly is made up of a turbine ring fastened onto the casing of the turbine by means of a spacer. In general, the ring and the spacer of such a stationary ring assembly are in the form of sectors, i.e. they are each made up of a plurality of segments joined end to end.

Since the stationary ring assembly defined in this way is in direct contact with the hot gas coming from the combustion chamber, it is necessary to cool the various segments which make up said assembly. To this end, air taken from the end of the combustion chamber flows into a cooling circuit formed in each segment of the stationary ring assembly and is exhausted into the gas flow path, upstream from the moving blades of the turbine.

It is also necessary to provide sealing between the adjacent segments of the stationary ring assembly so as to avoid air leaks that are particularly detrimental to good cooling of the segments. To this end, it is known to interpose sealing strips between the adjacent segments. Such strips are generally received in facing axial and facing radial slots formed in the adjacent side faces of the segments. They thus serve to obstruct the clearance that exists between two adjacent segments, so as to limit air leaks regardless of the amount of thermal expansion to which the segments are subjected.

The radial and axial slots in which the sealing strips are received are generally machined so that they are contiguous, i.e. so that they communicate with one another. This arrangement is made necessary by the fact that the sealing strips must maximize the area they cover of the side faces of the segments so as to obtain good sealing.

However, in practice, it should be observed that such an arrangement of the slots generates significant air leaks at the junctions between the axial and radial slots. Such leaks are shown in FIG. 5. In this figure, two segments 100, 100' of the stationary ring assembly are shown in part, each segment being provided with an axial slot 102, 102' and with a radial slot 104, 104'. The clearance 110 that exists between the strips and the slots results from the fact that, since the segments are exposed to the hot gas coming from the combustion chamber, they are subjected to thermal expansions and contractions which are passed on to the clearance 112 that exists between the two adjacent segments.

As a result of the distribution of pressure in the cooling circuit of the segments 100, 100', air leaks occur at the junctions between the axial and radial slots 102, 102' and 104, 104' (the leaks are shown by shading in the figure). Such leaks are particularly detrimental to the cooling of the segments and to the efficiency of the turbine.

OBJECT AND SUMMARY OF THE INVENTION

The present invention thus seeks to mitigate such drawbacks by proposing a gas-turbine stationary ring assembly that is made up of segments having slots and sealing strips that present a particular shape that makes it possible to reduce leaks between two adjacent segments.

To this end, a stationary ring assembly forming a rotor shroud for a gas turbine is provided, the stationary ring assembly comprising a plurality of segments having adjacent side faces that are placed end to end with sealing means interposed therebetween, the sealing means comprising at least one axial sealing strip and at least one radial sealing strip respectively received in axial slots and in radial slots formed facing one another in the adjacent side faces of the segments, at least one end of each radial slot opening out into the corresponding axial slot, wherein each axial slot in a side face of a segment presents a depth that is greater than the depth of the corresponding radial slot, and wherein the axial sealing strip presents a width that is greater than the width of the radial strip.

The axial sealing strip received in the deeper slot makes it possible to cover the leakage sections observed in the prior art. In this way, it is possible to reduce air leaks between two adjacent segments, thereby making it possible to improve the cooling of said segments. For identical cooling, it is also possible to reduce the air flow needed for cooling, and thus increase the efficiency of the turbine.

Another advantage of the invention resides in the fact that these air leaks are eliminated without adding auxiliary parts (of the angle-bar type) that are detrimental to the weight of the assembly, without requiring the slots and the sealing strips to be modified significantly, and without leading to maintenance problems.

The stationary ring assembly may constitute a high-pressure turbine ring for a turbomachine. Under such circumstances, each ring segment may include, in each side face, two axial slots disposed towards its inner and its outer walls, and in which axial strips are received, and two radial slots disposed towards its upstream and its downstream walls, and in which radial strips are received.

The stationary ring assembly may also constitute a spacer on which the high-pressure turbine ring of the turbomachine is fastened. Under such circumstances, each spacer segment may include, in each side face, one axial slot in which an axial strip is received, and at least three radial slots, two of which are disposed towards its upstream and its downstream walls, and in which radial strips are received.

The present invention also provides a segment for a gas-turbine stationary ring assembly as defined above.

BRIEF DESCRIPTION OF THE DRAWINGS

Other characteristics and advantages of the present invention appear from the following description, given with reference to the accompanying drawings which show a non-limiting embodiment. In the figures.

DETAILED DESCRIPTION OF AN EMBODIMENT

Figure 1:
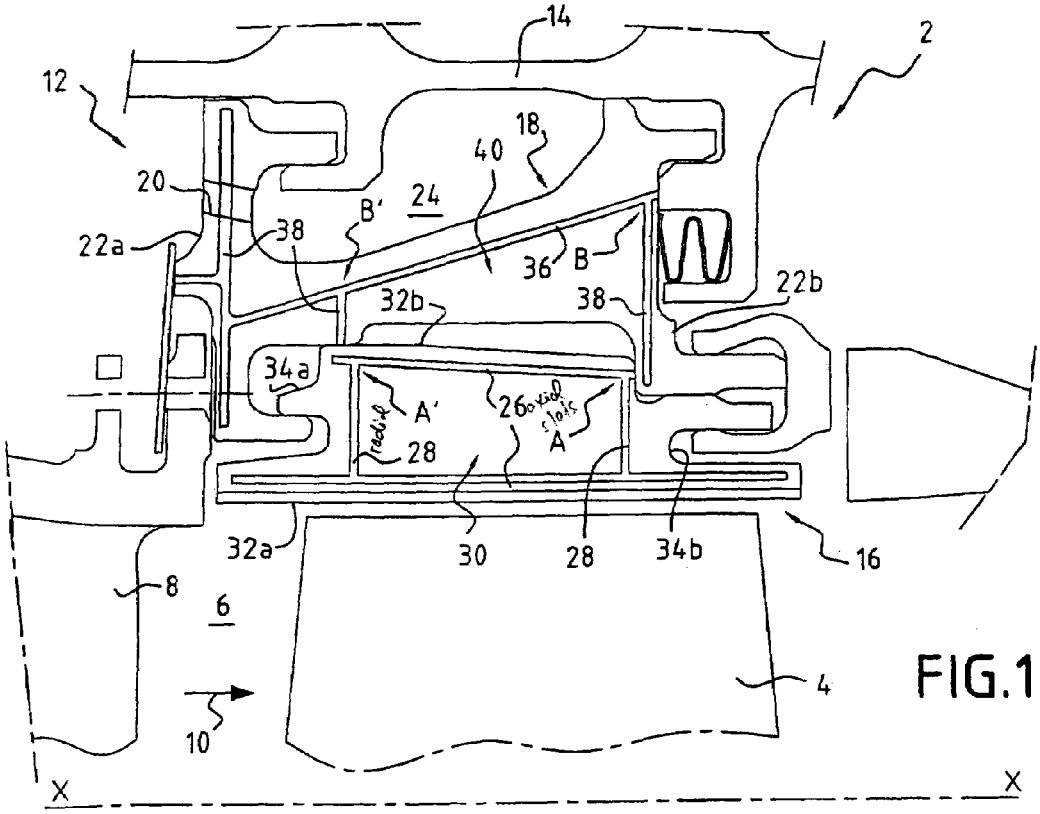
FIG. 1 is a longitudinal section view of a stationary ring assembly of the invention for a high-pressure turbine of a turbomachine.

With reference to FIG. 1, a turbomachine high-pressure turbine 2 of longitudinal axis X—X is made up in particular of a plurality of moving blades 4 forming a rotor and disposed in the annular flow-path 6 of a flow of hot gas coming from the combustion chamber (not shown). A plurality of stationary blades 8 forming a high-pressure nozzle are also disposed in the flow path 6, upstream from the moving blades 4 relative to the flow direction 10 of the gas.

The moving blades 4 are surrounded by a stationary ring assembly 12 forming a shroud. The stationary ring assembly is made up of a turbine ring fastened onto a casing 14 of the turbine by means of a plurality of spacer segments 18. More particularly, the turbine ring is made up of a plurality of ring segments 16 joined end to end. By way of example, there can be two ring segments 16 mounted on a single spacer segment 18.

The stationary ring assembly 12 defined in this way includes an air-flow circuit making it possible to cool the ring and spacer segments 16 and 18 which are exposed to the hot gas coming from the combustion chamber.

To do this, the stationary ring assembly 12 is provided with a cooling circuit. A hole 20 is pierced in the upstream radial wall 22*a* of each spacer segment 18 and opens out into a cavity 24 formed between the casing 14 and the spacer segment 18. The air delivered into the cavity 24 is taken from the end of the combustion chamber and then feeds a cooling circuit of the spacer segment 18 and of the ring segment(s) 16 mounted thereon. The air is finally exhausted into the hot-gas flow path 6, upstream from the moving blades 4 of the turbine.

In addition, since the ring and the spacer of the stationary ring assembly 12 are in the form of sectors, air leaks between two adjacent segments 16, 18 need to be limited.

To this end, sealing barriers are interposed between two adjacent ring and spacer segments 16 and 18. The barriers are constituted by sealing strips received in facing axial and facing radial slots formed in the adjacent side faces of the segments 16, 18.

The term "axial slots" refers to slots that extend substantially axially, i.e. parallel to the longitudinal axis X—X of the high-pressure turbine 2. In addition, the term "radial slots" refers to slots that extend substantially radially, i.e. along a direction perpendicular to the longitudinal axis X—X.

Each ring segment 16 is thus provided with at least one axial slot 26 and with at least one radial slot 28 formed in each of its side faces 30.

In FIG. 1, each side face 30 of the ring segment includes two axial slots 26 and two radial slots 28. By way of example, the axial slots 26 are disposed towards the inner and the outer walls 32*a* and 32*b* of the ring segment 16. The radial slots 28 are positioned towards the upstream and the downstream axial walls 34*a* and 34*b* of the segment 16, for example.

Such a distribution of the axial and radial slots 26 and 28 thus enables the sealing strips to cover a large area of the side faces 30 of the ring segments 16 so as to provide good sealing between two adjacent ring segments.

In addition, as a result of this good distribution, both ends of the two radial slots 28 open out into the axial slots 26. It can also be envisaged that only one end of each radial slot 28 opens out into the axial slots.

In addition, each spacer segment 18 is provided with at least one axial slot 36 and with at least one radial slot 38 formed in each of its side faces 40.

Figure 2:
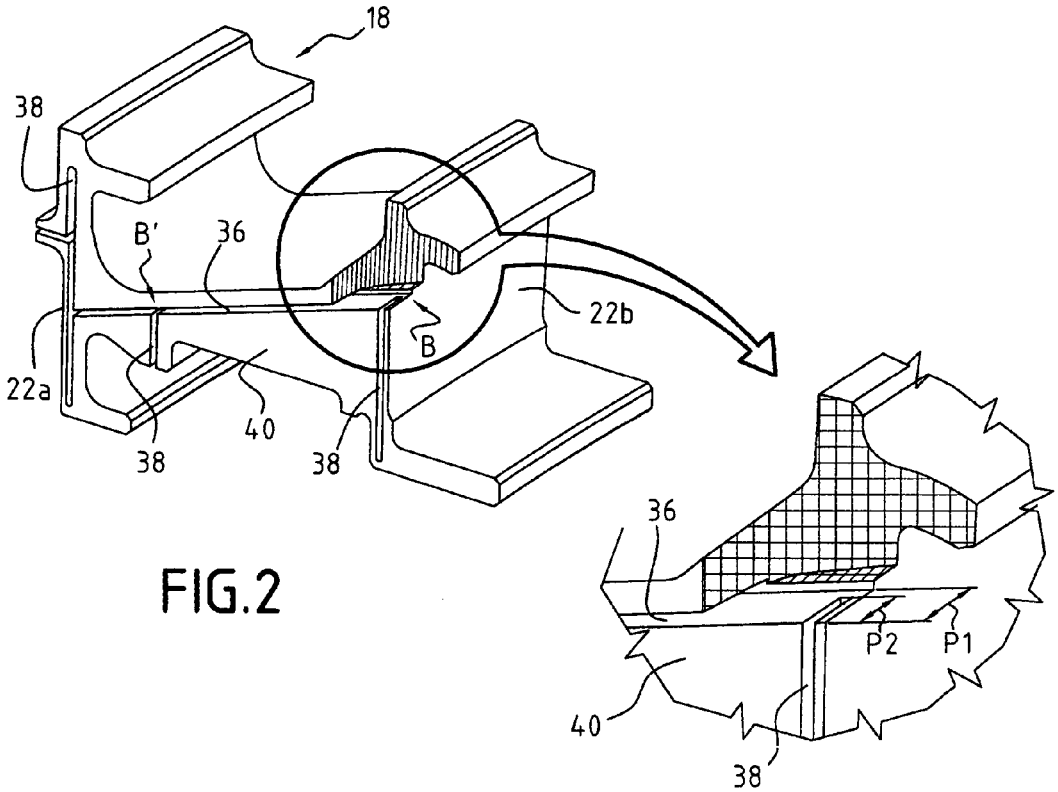
FIG. 2 is a perspective view showing a spacer segment of the FIG. 1 stationary ring assembly.

In FIGS. 1 and 2 and by way of example, each side face 40 of the spacer segment 18 includes one axial slot 36 and three radial slots 38, two of which are disposed towards its upstream and its downstream axial walls 22*a* and 22*b*.

As a result of the need to provide good distribution of the axial and radial slots 36 and 38 over the entire area of each side face 40 of the spacer segment 18, two radial slots 38 open out at one of their ends into each axial slot 36.

Sealing strips are received in the axial and radial slots 26, 36 and 28, 38 of the ring and spacer segments 16 and 18, which sealing strips serve to obstruct in part the clearance that exists between two adjacent segments, so as to limit air leaks.

Unfortunately, air leaks occur at the junctions between some of the axial and radial slots. In particular, leaks occur in the ring segments 16 at junctions A and A' (FIG. 1) between the two radial slots 28 and the axial slot 26 formed towards the outer wall 32*b*. In addition, leaks are observed in the spacer segments 18 at junctions B and B' (FIG. 1) between the two radial slots 38 and the axial slot 36.

In the invention, in order to limit such leaks, each axial slot 26, 36 of the side faces 30, 40 of each ring and spacer segment 16 and 18 presents a depth that is greater than the depth of the radial slot(s) 28, 38, and the sealing strips received in the axial slots present a width that is greater than the width of the sealing strips received in the radial slots.

The term "slot depth" refers to the depth to which the slot is machined into the material of the segment under consideration. The term "strip width" refers to the distance between the two side edges of the barrier, via which edges the strip is positioned in the slots.

This characteristic is shown in particular in FIG. 2 which shows a spacer segment 18. In this figure, it can clearly be observed that at the junction B, the axial slot 36 presents a depth P1 that is greater than the depth P2 of the radial slot 38 which opens out into the axial slot 36. Naturally, this characteristic also applies to the junction B' of the spacer segment 18, and to the junctions A and A' of the ring segment 16 (FIG. 1).

Figure 3:
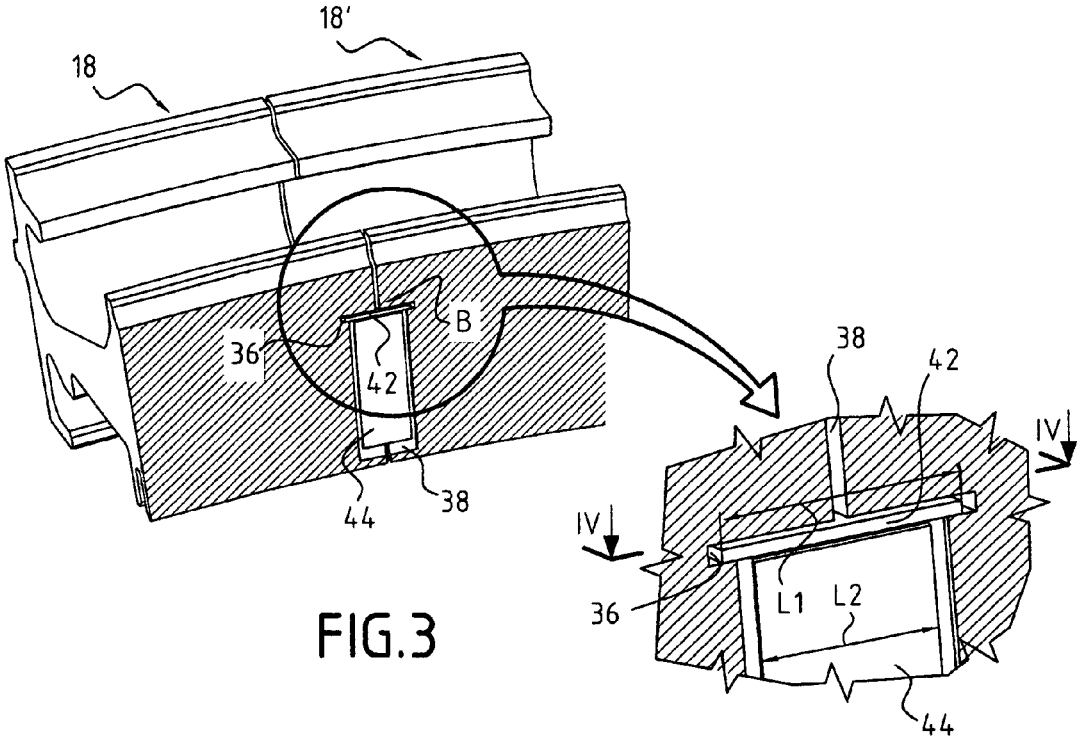
FIG. 3 is a perspective and partially cut-away view showing two FIG. 2 spacer segments joined end to end.

FIG. 3 shows two adjacent spacer segments 18, 18' joined end to end, and also shows the junction B between the axial and radial slots 36 and 38. An axial sealing strip 42 is received in the axial slot 36 and a radial sealing strip 44 is received in the radial slot 38.

Figure 4:
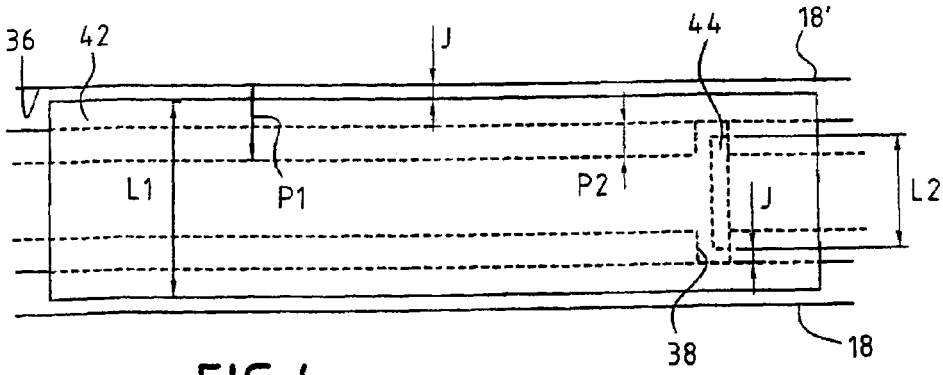
FIG. 4 is a section view on IV—IV of FIG. 3; and above-described
Figure 5:
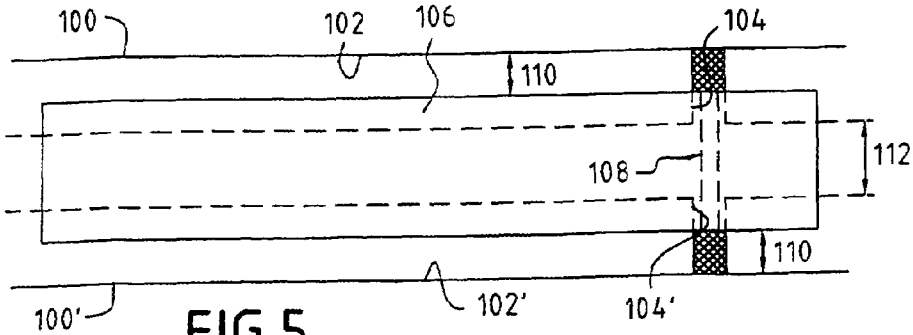
FIG.5 PRIOR ART
FIG. 5 shows the leakage problems encountered in a stationary ring assembly of the prior art.

In FIGS. 3 and 4, it can clearly be observed that the axial sealing strip 42 presents a width L1 that is greater than the width L2 of the radial sealing strip 44. Naturally, although not shown, this characteristic relating to the width of the sealing strips also applies to the junction B' of the spacer segment 18, and to the junctions A and A' of the ring segment 16 (FIG. 1).

Air leaks at the junctions between axial and radial slots 26, 36 and 28, 38 of the ring and spacer segments 16 and 18 can thus be avoided. In particular, for the spacer segments 18, it should be observed that the pressure of the air fed to their cooling circuit is greater beside the cavities 24 (FIG. 1) than beside the flow path 6. The air flowing between two adjacent segments 18, 18' (FIG. 3) will thus tend to press the axial sealing strip 42 against the bearing surfaces of the axial slot 36 on which it rests, thereby preventing air from leaking via the radial slots 38 at their junctions with the axial slot. In this way, any risk of leakage is avoided.

Naturally, this characteristic also applies to ring segments 16 for which the pressure of the air supplying their cooling circuit is greater beside their outer walls 32*b* than beside their inner walls 32*a* (FIG. 1).

With reference to FIG. 4, it should also be observed that clearance J exists between the strips 42, 44 and the axial and radial slots 36 and 38 in which they are received. This clearance J is necessary to accommodate the thermal expansions and contractions to which the adjacent spacer segments 18, 18' (and by analogy the ring segments) are subjected.

The above-described stationary ring assembly constitutes part of a turbomachine high-pressure turbine. Naturally, the present invention applies to any other type of segmented ring in which it is necessary to provide sealing between adjacent segments, e.g. such as a high-pressure nozzle in a turbomachine.

What is claimed is:

1. A stationary ring assembly forming a rotor shroud for a gas turbine, the stationary ring assembly comprising:

a plurality of segments having adjacent side faces that are placed end to end with sealing means interposed therebetween, the sealing means including at least one axial sealing strip and at least one radial sealing strip respectively received in axial slots and in radial slots formed facing one another in the adjacent side faces of the segments, at least one end of each radial slot opening out into the corresponding axial slot, wherein each axial slot of a segment presents a depth that is greater than the depth of the corresponding radial slot, the axial sealing strip presents a width that is greater than the width of the radial strip, and each radial slot does not extend beyond the corresponding axial slot.

2. The assembly according to claim 1, constituting a high-pressure turbine ring for a turbomachine.

3. The assembly according to claim 2, wherein each ring segment includes, in each side face, two axial slots disposed towards its inner and its outer walls, and in which axial strips are received, and two radial slots disposed towards its upstream and its downstream walls, and in which radial strips are received.

4. The assembly according to claim 1, constituting a high-pressure turbine spacer for a turbomachine.

5. The assembly according to claim 4, wherein each spacer segment includes, in each side face, one axial slot in which an axial strip is received, and at least three radial slots, two of which are disposed towards its upstream and its downstream walls, and in which radial strips are received.

6. A turbine including the assembly of claim 1.

7. A turbomachine including the assembly of claim 1.

8. A segment for a gas-turbine stationary ring assembly comprising:

side faces configured to be placed end to end with sealing means interposed therebetween, the side faces including axial slots and radial slots configured to receive sealing means including at least one axial sealing strip and at least one radial sealing strip, respectively, at least one end of each radial slot opening out into the corresponding axial slot, wherein each axial slot of a segment presents a depth that is greater than the depth of the corresponding radial slot, and each radial slot does not extend beyond the corresponding axial slot.

* * * * *